United States Patent [19]

Gabrielidis

[11] Patent Number: 4,878,305

[45] Date of Patent: Nov. 7, 1989

[54] HAND-CARRIED WEAPON

[76] Inventor: Pericles Gabrielidis, 14141 Riverside Dr., #1, Sherman Oaks, Calif. 91423

[21] Appl. No.: 260,864

[22] Filed: Oct. 21, 1988

Related U.S. Application Data

[63] Continuation-in-part of Ser. No. 44,655, May 1, 1987, abandoned.

[51] Int. Cl.[4] ..... F41C 23/00

[52] U.S. Cl. ..... 42/72; 42/100

[58] Field of Search ..... 42/72, 100

[56] References Cited

U.S. PATENT DOCUMENTS

| | | | |
|---|---|---|---|
| 1,174,282 | 3/1916 | Richard . | |
| 1,184,078 | 5/1916 | Cooke . | |
| 1,195,055 | 8/1916 | McNeal . | |
| 1,260,285 | 3/1918 | Cordell . | |
| 1,269,178 | 6/1918 | Hamilton . | |
| 1,300,688 | 4/1919 | Bellard . | |
| 2,627,132 | 2/1953 | Dolgacius . | |
| 3,817,148 | 6/1974 | Schirneker . | |

FOREIGN PATENT DOCUMENTS

| | | | |
|---|---|---|---|
| 77834 | 12/1918 | Austria | 42/100 |
| 77840 | 12/1918 | Austria | 42/100 |
| 77835 | 8/1919 | Austria | 42/100 |
| 77842 | 8/1919 | Austria | 42/100 |
| 78115 | 9/1919 | Austria | 42/100 |
| 300124 | 10/1919 | Fed. Rep. of Germany | 42/100 |
| 305165 | 6/1920 | Fed. Rep. of Germany | 42/100 |
| 306490 | 6/1920 | Fed. Rep. of Germany | 42/100 |
| 324067 | 8/1920 | Fed. Rep. of Germany | 42/100 |
| 514142 | 12/1930 | Fed. Rep. of Germany | 42/100 |
| 22099 | 5/1921 | France | 42/100 |
| 1027684 | 5/1953 | France | 42/100 |
| 1139692 | 7/1957 | France | 42/100 |
| 1159347 | 6/1958 | France | 42/100 |
| 10983 | 7/1902 | Norway | 42/100 |
| 41692 | 7/1925 | Norway | 42/100 |
| 143431 | 1/1931 | Switzerland | 42/100 |
| 651921 | 10/1985 | Switzerland | 42/100 |
| 21318 | 10/1914 | United Kingdom | 42/100 |
| 3454 | 3/1915 | United Kingdom | 42/100 |
| 4900 | 4/1915 | United Kingdom | 42/100 |
| 8469 | 6/1915 | United Kingdom | 42/72 |
| 101830 | 10/1916 | United Kingdom | 42/100 |
| 107717 | 7/1917 | United Kingdom | 42/100 |
| 124771 | 4/1919 | United Kingdom | 42/100 |

*Primary Examiner*—Charles T. Jordan
*Assistant Examiner*—Richard W. Wendtland
*Attorney, Agent, or Firm*—Allan M. Shapiro

[57] ABSTRACT

Hand-carried weapon has a stock offset below the barrel and receiver so that a shooter can keep his head below the barrel to fire from the protected position. A movable periscopic sight, when in the raised position, permits the shooter to see along a periscope-offset line-of-sight parallel to the axis of the barrel so that he can sight from a protected position. When the shooter has his head below the axis of the barrel, he can place his forehead firmly against the periscope to provide triangle support for the weapon with his forehead and two hands. When the periscope is in the lowered position, the shooter can hold and shoot the weapon with his eye on a straight line-of-sight through the sights, without being in the protected position. Secondary trigger permits the shooter to actuate the primary trigger from the protected position. The weapon can also be used to shoot from the hip.

25 Claims, 3 Drawing Sheets

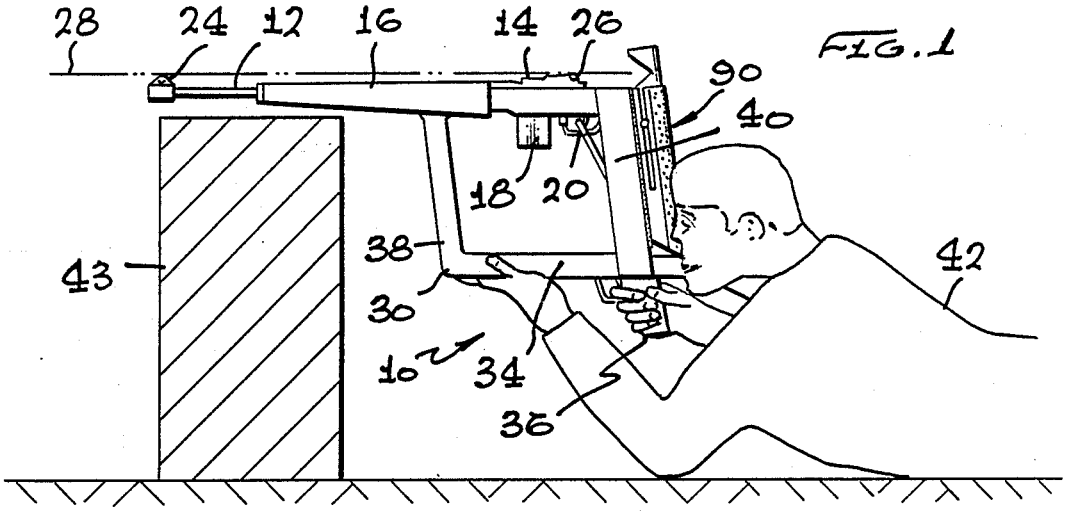
FIG. 1
FIG. 3
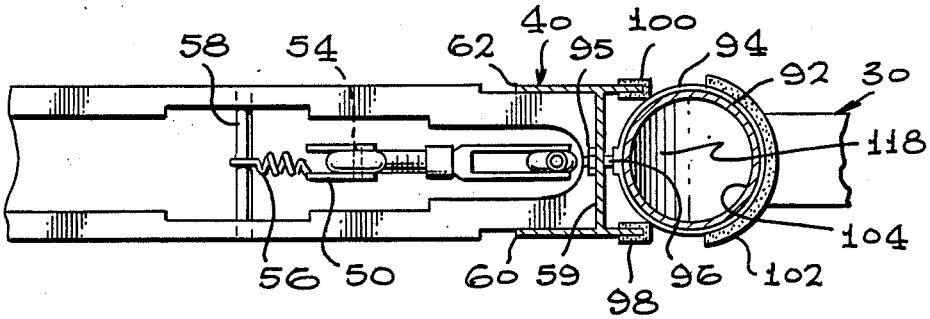
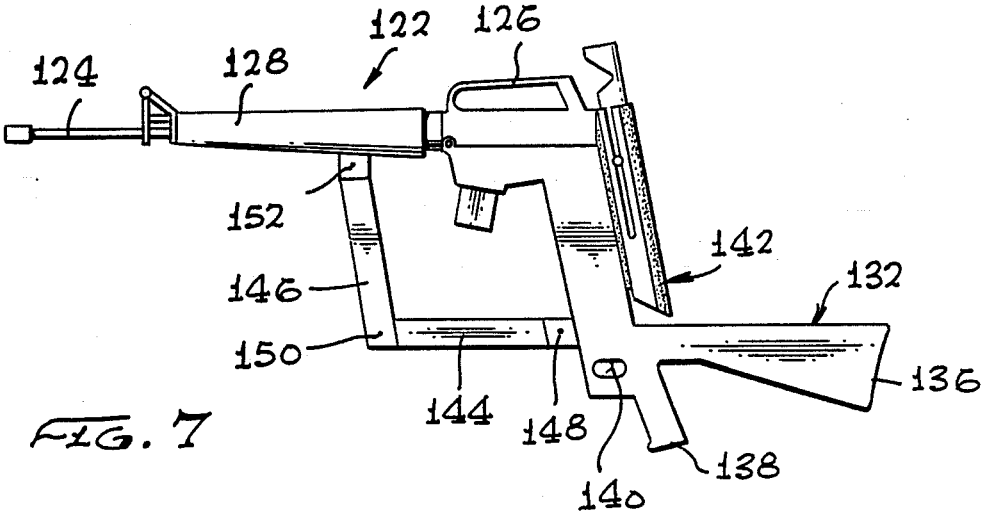
FIG. 7

16
86
22
84
72
62
40
64
20
60
66
32
30
114
118
116
95
94
3
1
108
102
106
90
92
104
120
98
60
40
26
28
14
102
16
88
87
20
22
66
64
96
4
50
56
58
48
44
46
18
38
34

FIG. 5
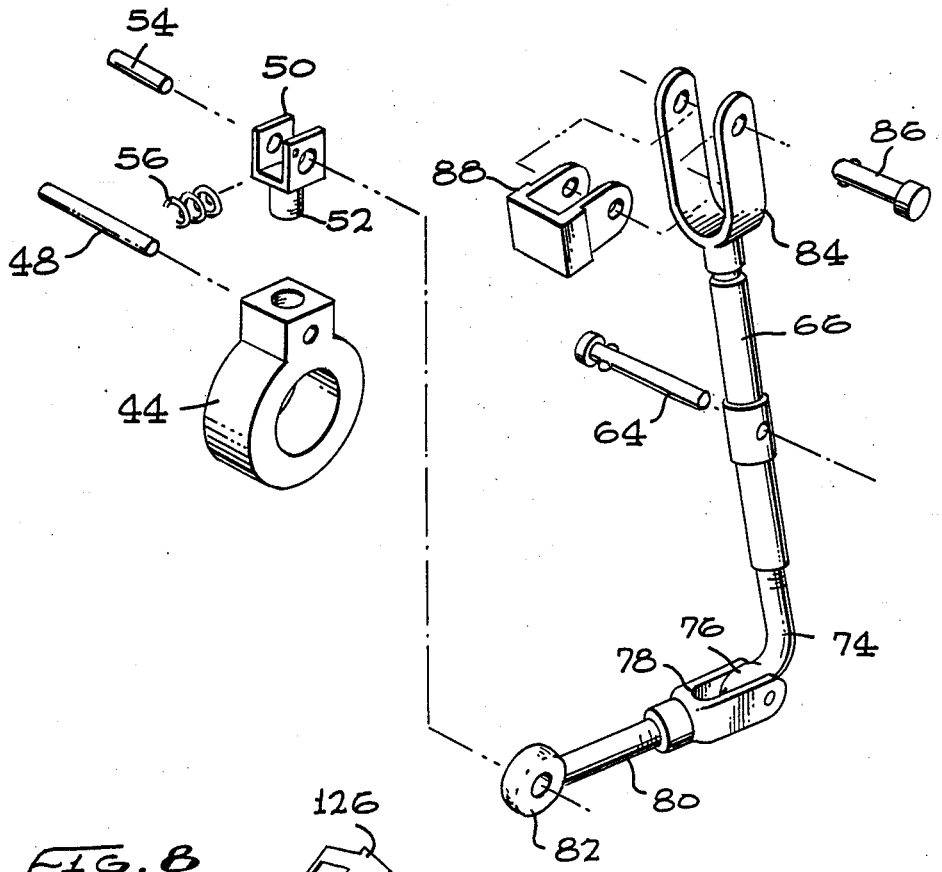
FIG. 8
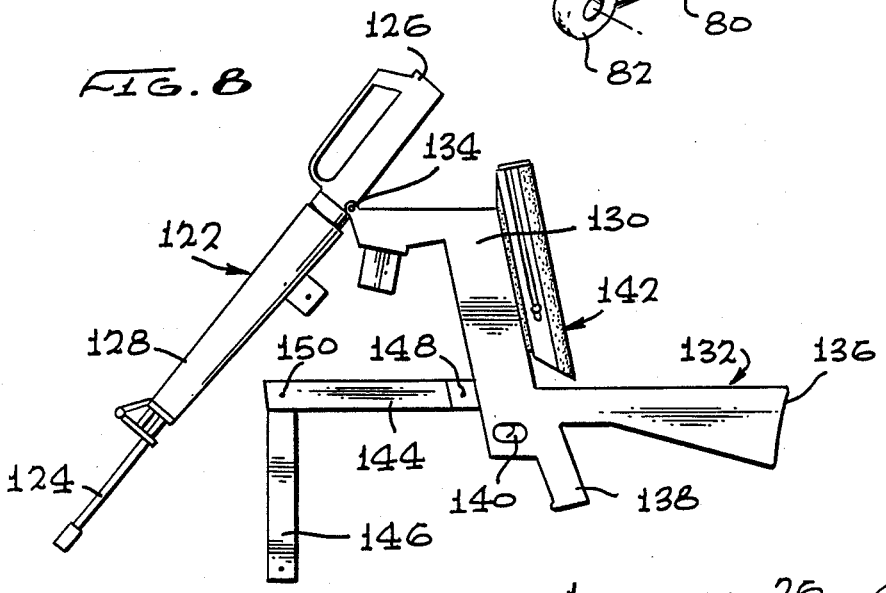
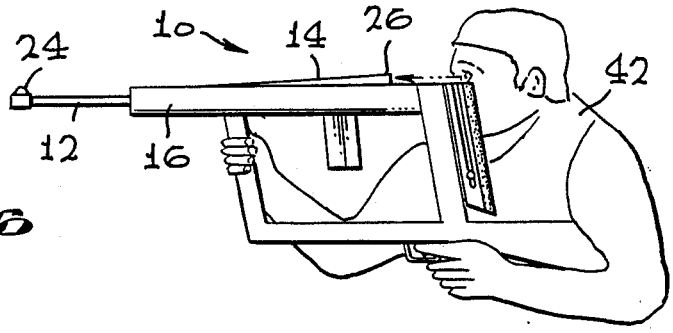
FIG. 6

HAND-CARRIED WEAPON

CROSS-REFERENCE

This application is a continuation-in-part of my earlier application Ser. No. 44,655, filed May 1, 1987 now abandoned, entitled "Hand-Carried Weapon", the entire disclosure of which is incorporated herein by this reference.

FIELD OF THE INVENTION

This invention is directed to a hand-carried weapon wherein the weapon-holding structure is offset from a barrel and the sight line. With the sighting periscope in its raised position to intersect the sight line, the shooter can hold himself in a protected position while the barrel and sighting line are exposed to be directed toward a target. His forehead can be firmly pressed on the periscope to add weapon position stability. when the sighting periscope is in its lowered position, the shooter can sight directly on the sight line.

BACKGROUND OF THE INVENTION

In the conventional shoulder-aimed firearm, which is the most accurate of the hand-carried weapons, the barrel is mounted upon a stock which extends rearwardly to rest against the shooter's shoulder as a shoulder stock. When the weapon is in firing position, the shoulder stock is against the shoulder and the eye is on the line-of-sight which is directly above the barrel. The sights by which the firearm is aimed are normally mounted upon the barrel and/or receiver. By careful aim, such hand-carried weapons can accurately place a bullet.

A problem of such weapons was encountered in World War I when they were used in trench warfare. The shooter's head was exposed when he was aiming his weapon. Several patents were granted which disclosed the use of a prism mounted behind the rear sight in such a manner that the prism permits a view down the line-of-sight from a right angle position beside the weapon. Such prisms did not permit accurate shooting because the weapon could not permit accurate shooting because the weapon could not be securely held and the sighting view was unnatural.

Periscopes were also available in trench warfare, and such periscopes were semi-permanently attached to the shoulder-aimed firearm. Difficulties arose because the firearm was not capable of being used by direct sighting down the line-of-sight because such structures were not provided so as to be able to quickly and easily remove the periscope from obstructing the direct line-of-sight. Thus, there is need for a handcarried weapon which permits the shooter to remain in a protected position while the barrel of the weapon can be directed at a target and properly held during shooting.

SUMMARY OF THE INVENTION

In order to aid in the understanding of this invention, it can be stated in essentially summary form that it is directed to a hand-carried weapon wherein the portion of the stock of the weapon which receives and retains the barrel and receiver is offset from the portion of the stock which abuts the shoulder and is held by the shooter that the shooter is able to keep himself hidden. In addition, the weapon is equipped with a movable periscope so that, when the periscope is in the active position, the shooter from the hidden position can sight down the line-of-sight adjacent the barrel. The periscope is positioned and padded so that the shooter's forehead can be firmly pressed against the periscope to stabilize the weapon by triangular support. When the periscope is in the inactive position the shooter can sight directly on the sighting line.

It is thus a purpose and advantage of this invention to provide a hand-carried weapon which can be employed by a shooter who remains in a protected position while the barrel and line-of-sight of the weapon are exposed so that the weapon can be aimed and discharged.

It is another purpose and advantage of this invention to provide a hand-carried weapon wherein a periscope is employed to offset the line-of-sight along the weapon barrel to a position wherein the shooter may view the line-of-sight for pointing the weapon, without the shooter exposing himself.

It is a further purpose and advantage of this invention to provide a hand-carried weapon wherein the periscope which is used to offset the shooter's head from the line-of-sight of the weapon is positioned so that the shooter can engage his forehead firmly against the periscope to aid in stabilizing the weapon.

It is another purpose and advantage of this invention to provide a weapon which can be employed in three different shooting modes, including shooting from the hip, shooting with the eye on the weapon line-of-sight and shooting with the head offset from the line-of-sight, without the need for assembly or disassembly procedures.

It is a further purpose and advantage of this invention to provide a weapon with an offset structure including a trigger and means to hold the weapon so that the shooter may hold the weapon and discharge it from an offset position without exposing himself at the line-of-sight of the barrel of the weapon.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the first preferred embodiment of the hand-carried weapon of this invention showing the manner in which it is employed by a shooter to be aimed and fired without exposing the shooter.

FIG. 3 is a downwardly looking section, on slightly enlarged scale, taken generally along the line 3—3 of FIG. 2.

FIG. 5 is an enlarged exploded view of the secondary trigger mechanism shown in FIG. 2, shown on the same scale as FIG. 4.

FIG. 6 is a view similar to FIG. 1, but showing a left-handed shooter aiming the weapon with the periscope sight lowered and with the shooter's eye on the line-of-sight.

FIG. 7 is a side-elevational view, similar to FIG. 1, of a second preferred embodiment of the hand-carried weapon of this invention.

FIG. 8 is a view similar to FIG. 7, showing the weapon in FIG. 7 in an open position.

DESCRIPTION OF THE PREFERRED EMBODIMENTS

Figures 2, 4:
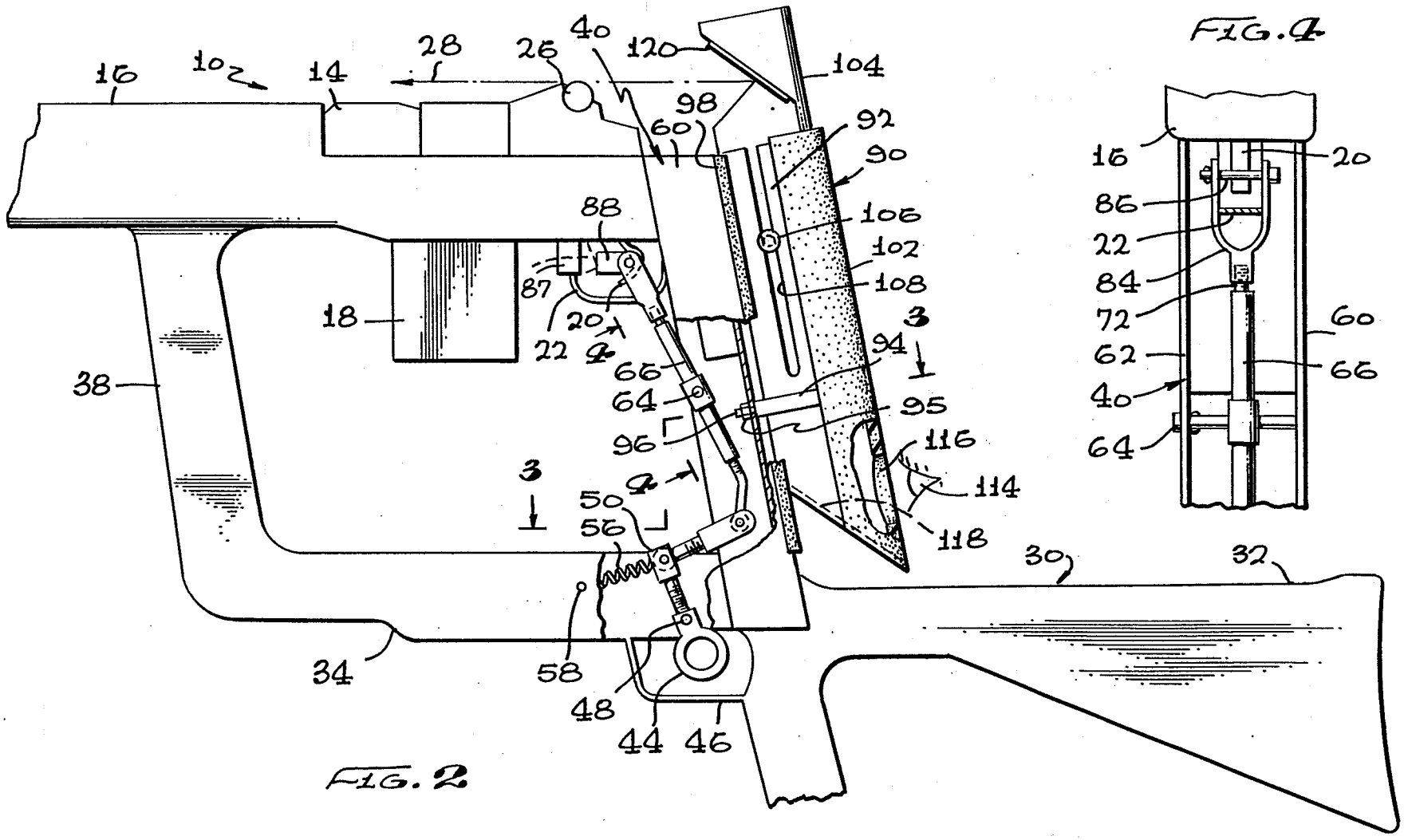
FIG. 2 is a side-elevational view thereof, with parts broken away and parts taken in section.
FIG. 4 is an enlarged view, with parts broken away, taken generally along the line 4—4 of FIG. 2.

The first preferred embodiment of the hand-carried weapon of this invention is generally indicated at 10 in FIGS. 1, 2 and 6. The weapon 10 has a barrel 12 and a receiver 14 mounted in an upper fore stock 16. These are of the conventional configuration of some of the modern-day hand-carried semi-automatic and automatic infantry weapons. Clip 18 carries additional rounds which are fed to the chamber in the receiver as required. Firing is controlled by trigger 20 housed within trigger guard 22. Fore sight 24 and rear sight 26 define a line-of-sight 28 which is substantially parallel to the axis of the barrel so that, when the line-of-sight is directed at a target, the barrel is expected to deliver a bullet to the target.

To raise this conventional structure sufficiently high so that the shooter can be protected behind an obstruction while the barrel and line-of-sight extend above the obstruction, stock 30 is provided. Stock 30 comprises butt stock 32 for resting against the shoulder, fore stock 34 for steadying by the left hand, and piston grip 36 for engagement by the right hand of a right-handed user. The separate piston grip is absent in some stock configurations, and the hand may grasp around the main body of the stock. This invention is also useful therewith. Stock 30 is spaced below upper fore stock 16 by handpiece 38 and post 40. As seen in FIG. 1, when the shooter 42 places butt stock 32 against his shoulder, grasps piston grip 36 in his right hand and fore stock 34 in his left hand, the shooter's head, hands and arms are completely below the level of upper fore stock 16. As seen in FIG. 1, the shooter can remain in a protected position behind wall 43 while the barrel and line-of-sight can be positioned above the wall. By rotating the weapon around the axis of its barrel, the barrel can be extended laterally around the end of a wall without exposing the shooter.

In order to permit the shooter to discharge the weapon while he is in a protected position, stock 30 is provided with secondary trigger 44 which is positioned in front of piston grip 36 and within trigger guard 46. The trigger 44 is pivoted in fore stock 34 on pin 48, see FIG. 5. Bifurcated yoke 50 carries a threaded stud 52 on its lower portion, see FIG. 5, and this stud is threaded into a threaded hole on the top of the trigger. Connector pin 54 is press-fitted or threaded into a corresponding transverse hole in the top of yoke 50. The distance the stud 52 is screwed into trigger 44 adjusts the lever arm distance between pivot pin 48 on which lower trigger 44 is pivotably mounted and the connector pin 54. A hole in the yoke 50 receives a hook on one end of tension spring 56. The other end of the tension spring 56 is hooked on a pin 58 in fore stock 34, forward of the trigger. Tension spring 56 is a light spring which pulls the trigger in the firing direction. Its utility will be discussed below.

As is best seen in FIG. 3, post 40 is H-shaped with a web and left and right flanges 60 and 62. Main pivot pin 64 is pivoted on these flanges, as is seen in FIG. 4. Body 66 has a cross hold therethrough through which main pivot pin 64 extends. The upper and lower ends of body 66 have a threaded hole therein.

Eyebolt 74, see FIG. 5, is threaded into the lower end of body 66 so that the distance between its eye 76 and main pivot pin 64 can be adjusted. Eye 76 is engaged on a pin passing through lower yoke 78. The lower yoke 78, in turn, is threadedly engaged by eyebolt 80. Eyebolt 80 has eye 82 which is engaged by pin 54.

Upper trigger yoke 84, best seen in FIG. 4, is threaded onto stud 72 on the top of body 66. Yoke 84 is sufficiently wide to fit around upper trigger guard 22. Trigger pin 86 passes through holes in the forks of the yoke. The yoke embraces the trigger guard 22, and trigger pin 86 engages against trigger 20. The weapon 10 has a safety 87 at the front of trigger guard 22. This safety must be pressed forward to unlock the firing mechanism. To accomplish this, safety actuator 88 is mounted upon trigger pin 86 within the yoke 84 and is positioned within the trigger guard. Trigger 44 is configured to be circular so that the trigger finger can be inserted therethrough. When the trigger finger is thrust forward, safety actuator 88 thrusts forward on safety 87 to unlock the mechanism. When it is unlocked, pulling back on the trigger 44 causes trigger pin 86 to pull back on the trigger 20 to fire the weapon.

This structure is configured so that it can be applied to an existing weapon after the weapon is manufactured. That is the reason for the particular configuration of post 40 and the adjustability of the trigger mechanism. If the weapon 10 was originally manufactured in the configuration shown in FIGS. 1 and 2, the second trigger mechanism between the secondary trigger 44 and trigger pin 86 could be enclosed. The adjustments at the top and bottom of body 66 and the adjustment of yoke 50 in secondary trigger 44 provide adjustments of the strength of pull of secondary trigger 44 as compared to the pull of trigger 20. The upward adjustment of yokes 84 and 50 produces a harder, shorter stroke of secondary trigger 44 while the lengthening of eyebolt 74 in the downward direction increases the stroke of secondary trigger 44 while decreasing the trigger pull force. The adjustment of eyebolt 80 in yoke 78 adjusts the position of secondary trigger 44 within its trigger guard 46. Tension spring 56 urges secondary trigger 44 in the pull direction and takes the slack out of the secondary trigger mechanism so there is no lost motion when the secondary trigger 44 is pulled.

The hand-carried weapon 10 is thus equipped so that the shooter 42 can hold the weapon while he remains in a protected position. Sight 90 permits him to view a target and point the weapon from the protected position. An important additional function of the sight is as a head rest. The shooter can steady the weapon by firmly pressing his forehead against the upright portion of the sight and thus hold the weapon with both hands and steady it with his forehead to provide triangular support to the weapon. Sight 90 has a round body tube 92 which is secured onto post 40 by means of strap 94. Strap 94 carries stud 96, which engages through an opening in the web of post 40. A nut 95 on stud 96, forward of the web, secures the body tube in place. In order to properly bed the body tube against the rear edges of flanges 60 and 62, the flanges are each fitted with a resilient U-shaped edging. As is seen in FIGS. 2 and 3, U-shaped edging 98 engages over the rear edge of left flange 60 and, as seen in FIG. 3, resilient U-shaped edging 100 engages over the rear edge of right flange 62. The edging is sufficiently resilient so that strap 94 can indent therein, as seen in FIG. 3, and the length of body tube 92 can lie against the edging to be firmly bedded. The rear face of body tube 92 carries resilient cushion 102 so that the shooter's head may lie there-against so that the shooter's forehead may be thrust firmly against the cushion to support the weapon. By supporting the weapon in both of the shooter's hands plus the shooter's forehead being engaged against the cushion on the periscope tube, the weapon is supported at three points in a plane to provide additional weapon support. This support is satisfactory with modern lightweight weapons. As a result of this forehead support against the cushion on the sight, there is less barrel rise upon shooting for more accurate bullet placement. In addition, since there is less barrel rise, the weapon can be more quickly and easily resighted for the next shot. When the forehead is against the cushion, the shooter's eye is in proper position with respect to the sight, as will become apparent therebelow.

Upper tube 104 is slidably engaged within body tube 92. Bolt 106 is secured in upper tube 104 and slides in slot 108 in body tube 92. Bolt 106 is hand-loosened and tightened so the tube 104 can be vertically adjustably positioned and locked in place. The slot limits rotation of the upper tube with respect to the body tube and limits downward telescoping of the upper tube into the lower tube. In addition, the slot may have a stop at the top thereof to limit upward travel of the upper tube to limit the extended position to that shown in FIG. 2. The lowered limit position of the upper tube is where the top of the upper tube is below the line-of-sight 28 and is such that the top of the upper tube is substantially flush with the top of the body tube 92. In the lowered position, the sight is out of the way where it is fairly well protected from external damage, and the shooter can fire while sighting directly, as seen in FIG. 6.

The sight 90 has an opening in the body tube 92 adjacent the lower end thereof in the sight line from the shooter's eye 114. The opening is fitted with a lens 116 which faces angular mirror 118 to provide a proper field of view to the shooter. The angular mirror 118 directs the sight line from the eye upward through the sight to the angular mirror 120. Prisms or other equivalent optical devices can be used in place of mirrors. A forwardly directed opening adjacent angular mirror 120 is in alignment with the line-of-sight 28. Thus, with the upper tube 104 extended, the shooter can place his eye at position 114 and sight across line-of-sight 28 to aim the hand-carried weapon. The location of mirror 118 can be adjusted by loosening nut 95 and sliding body tube 92 to the selected position. In this way, the sight line and the field of view are positioned for the comfort and convenience of the particular shooter. The shooter holds the weapon in both hands, places his eye 114 where he has a field of view to the line-of-sight and firmly places his forehead against the cushion on sight tube 92 to stabilize the weapon during shooting. The shooting has a field of view through this optical system. The width of the field of view is a function of the size and shape of the elements in the optical system. Appropriate lenses may be used if magnification is desired. The line-of-sight to the target is in the field of view, often near its center. The line-of-sight 28 in the present case is defined by the sights on the weapon.

As previously discussed, in this use of the weapon 10, the shooter is hidden. He directs the weapon and aims line-of-sight 28 to the target through the use of the periscope sight 90. In another use of the weapon 10, when the shooter does not require protection behind and obstruction, the shooter may lower the upper tube 104 into the lowered position. He holds the butt stock 32 under his armpit, places his left hand on upper fore stock 16 of handpiece 38, and sights directly down the line-of-sight 28. He may use his right hand on either of the triggers 20 or 44, depending upon his reach, comfort and preference. The shooter's cheek may be thrust firmly against the cushion to support the weapon. By supporting the weapon in both of the shooter's hands plus the shooter's cheek being engaged against the cushion on the periscope tube, the weapon is supported at three points in a plane to provide additional weapon support. This support is satisfactory with modern lightweight weapons. As a result of this cheek support against the cushion on the sight, there is less barrel rise upon shooting for more accurate bullet placement. In addition, since there is less barrel rise, the weapon can be more quickly and easily resighted for the next shot. When the cheek is against the cushion, the shooter's eye is in proper position with respect to the sight.

Sometimes semi-automatic weapons and similar automatic weapons are discharged without direct aiming on the line-of-sight 28. When used in this way, the shooter places the butt stock 32 against his hip, uses upper fore stock 16 or handpiece 38 for engagement by his left hand, and uses his right hand on the upper trigger 20 on lower trigger 44. This "shooting from the hip" is usually not as accurate, but can be employed to quickly discharge a larger number of rounds. The present weapon thus can be fired in any one of three positions, with the periscope tube raised and the shooter's eye 114 looking into the lower periscope opening at lens 116, with the periscope lowered and the shooter's eye directly upon the line-of-sight 28, and shooting from the hip without direct sighting, all without assembly or disassembly, just by the simple raising and lowering of the periscope without structural change.

FIGS. 7 and 8 show a second preferred embodiment generally indicated at 122 of the hand-carried weapon of this invention. The hand-carried weapon 10 is of such construction that the receiver can be opened for access to the chamber without raising the receiver. Thus, the handpiece 38 and post 40 can be semi-permanently attached. However, in the case of the hand-carried weapon 122, it is necessary to raise the receiver, as is shown in FIG. 8, in order to achieve access for cleaning. In addition, the lower stock 30 of the handcarried weapon 10 is an after-market attachment to the weapon. In the case of the weapon 122, it is designed to be originally manufactured with the lower stock. Referring in detail to FIGS. 7 and 8, the weapon 122 has a barrel 124 mounted on receiver 126. The barrel carries a fore stock 128 so that, in some use conditions, the barrel may be grasped. Post 130 is integrally formed with stock 132. At its upper end, post 130 reaches forward and is pivoted on pin 134 to receiver 126. With this configuration, the barrel, receiver and fore stock can pivot forward, as is seen in FIG. 8. Stock 132 includes butt stock 136 and pistol grip 138. Trigger 140 is housed in a trigger guard forward of pistol grip 138 and is connected to actuate the firing mechanism in receiver 126. The connection mechanism extends upward through post 130. In this construction, there is no upper trigger. The connection mechanism between trigger 140 and the firing mechanism in the receiver preferably includes a pivoted body such as the body 66. Sight 142 is the same as the sight 90 and is shown in the raised position in FIG. 7 and in the retracted position in FIG. 8.

In order to permit the barrel to swing forward, the fore stock 144 and/or the handpiece 146 are pivoted at one or both ends. When all of the connecting pins are attached, the structure is rigid. When selected pins are moved, the barrel can be unlatched and pivoted forward. For example, the pin 148 can be removed and the pin 150 loosened to permit the fore stock 144 to fold up to a position forward of handpiece 146. With the fore stock 144 out of the way, the barrel can be tilted forward. On the other hand, pin 152 could be removed and pin 150 loosened so that the handpiece 146 can swing forward and downward to the position shown in FIG. 8. With the handpiece out of the way, the barrel can be tilted forward as shown. In this way, access to the receiver 126 for its dismantling and cleaning is achieved. Thus, the hand-carried weapon 122 can be employed to sight from a protected position, can be employed with the side of the butt stock 136 under the arm for directly sighting on the line-of-sight over the top of the sight on the receiver and barrel, and can be employed with the butt stock against the hip for from-the-hip shooting. In the same manner as with respect to the weapon 10, this weapon is sighted from a protected position with the periscope raised, and in this position, the forehead is firmly pressed against the padding on the periscope to provide the additional sighting stability. With the forehead pressed firmly against the periscope, the eye is in the field of view of the periscope to permit accurate sighting.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A hand-carried weapon comprising:

a stock, a grip on said stock configured to be engaged by a shooter's trigger operating hand, a trigger on said stock positioned to be actuated by the shooter when his trigger operating hand is on said hand grip;

a barrel mounted on said stock, said barrel being positioned so that its bore is sufficiently above said stock that when the shooter engages his trigger operating hand on said grip and his shoulder against said stock, the shooter's head is below said bore of said barrel;

at least one optical sight mounted with respect to said barrel to establish a sighting line adjacent and substantially parallel to said barrel so that when said sighting line is directed at a point, said barrel can discharge a bullet towards the point; and a periscope on said weapon, said periscope having first and second reflective optical elements therein, a rest surface on said periscope, said periscope having a first position in which said first reflective optical element is located so that when the shooter's face lies adjacent said stock with his forehead against said rest surface, the shooter's eye is in alignment with said first reflective optical element in said periscope and said second reflective optical element in said periscope is on said sighting line for indirect sighting, said second reflective element in said periscope being movable away from said sighting line so that the shooter can place his eye directly on the sighting line for direct sighting.

2. The hand-carried weapon of claim 1 wherein said barrel is pivotably mounted with respect to said stock.

3. The hand-carried weapon of claim 1 wherein said stock includes a shoulder stock and there is a fore stock connected to said shoulder stock forward of said shoulder stock and there is a handpiece connected to said fore stock with said handpiece directed upward to carry said barrel, at least one of said handpiece and said fore stock being pivotably mounted to permit pivoting of said barrel with respect to said stock.

4. The hand-carried weapon of claim 1 wherein said stock includes a shoulder stock and a fore stock and a handpiece is secured to said fore stock, said handpiece extending upward to support said barrel with respect to said stock.

5. The hand-carried weapon of claim 4 wherein there is also an upper fore stock above said fore stock and said barrel rests in said upper fore stock and said handpiece is secured to said upper fore stock.

6. The hand-carried weapon of claim 1 wherein said first reflective optical element of said periscope is a lower mirror in alignment with the shooter's eye and said second reflective optical element is an upper mirror movable into and out of alignment with the sighting line substantially parallel to the axis of said barrel so that the shooter can view a point on the sighting line while his head is below the axis of said barrel.

7. The hand-carried weapon of claim 6 wherein said periscope is telescoping with said mirror in alignment with the shooter's eye being fixed with respect to said stock and said mirror viewing the sighting line substantially parallel to the axis of said barrel being movable so that said second optical element movable from the first position to the second position mirror is movable toward said fixed mirror to move the telescoping portion of said periscope out of the sighting line.

8. The hand-carried weapon of claim 7 wherein said stock includes a fore stock and a handpiece is secured to said fore stock, said handpiece extending upward to support said barrel with respect to said stock.

9. The hand-carried weapon of claim 8 wherein there is also an upper fore stock above said fore stock and said barrel rests in said upper fore stock and said handpiece is secured to said upper fore stock.

10. A hand-carried weapon comprising: a stock graspable by a shooter, said stock having a trigger mounted thereon;

a barrel having an axis, said barrel being mounted on said stock and positioned with respect to said stock so that when a shooter grasps said stock the axis of said barrel does not intersect his head, a sight on said barrel defining a sighting line;

a periscope sight mounted on said stock, a headrest surface on said periscope, said periscope sight having an inlet aperture positioned where a shooter can see therein while he is grasping said stock and resting his head on said headrest surface, said periscope having a movable outlet aperture having a raised position wherein said outlet aperture is on said sighting line so that a shooter can grasp said stock, rest his head against said headrest surface, sight through said periscope and actuate said trigger to discharge a round out of said barrel in a direction substantially parallel to said sighting line with said weapon stabilized by the shooter's grasp of said stock and the positioning of his head against said headrest surface and said periscope, said outlet aperture of said periscope having a lowered position away from said sighting line so that the shooter can grasp the stock and sight directly along the sighting line.

11. The hand-carried weapon of claim 10 wherein said periscope sight comprises a body tube secured to said stock, said headrest being on said body tube, said body tube having a mirror adjacent said inlet aperture to direct the shooter's view substantially up through said body tube to the sighting line;

an upper tube telescopically fit with respect to said body tube, said upper tube having said outlet aperture therein and having a mirror adjacent said outlet aperture, said upper tube being telescopable downward to move said upper mirror into a protected lowered position below said barrel axis where the shooter can directly see the sighting line and being extendable to a position wherein said upper mirror is on the sighting line.

12. The hand-carried weapon of claim 11 wherein said body tube has a strap therearound and said strap is secured to said stock to secure said sight to said stock.

13. The hand-carried weapon of claim 11 wherein a pin on one of said tubes is engaged in a slot in the other of said tubes so that said tubes are telescopically slidable with respect to each other without rotation.

14. The hand-carried weapon of claim 11 wherein said headrest is a cushion secured to said periscope so that discharge of said weapon is stabilized by the shooter's head engaged against said headrest.

15. The hand-carried weapon of claim 12 wherein a pin on one of said tubes is engaged in a slot in the other of said tubes so that said tubes are telescopically slidable with respect to each other without rotation.

16. The hand-carried weapon of claim 10 wherein said trigger is a secondary trigger and there is a receiver connected to said barrel and a primary trigger mounted on said receiver to discharge said firearm; and a secondary trigger mechanism connected to said secondary trigger to be actuated by motion of said secondary trigger, said secondary trigger mechanism being connected to said primary trigger to discharge said firearm.

17. The hand-carried weapon of claim 16 wherein said secondary trigger mechanism comprises a body, said body being pivoted in said stock, said body having an adjustable yoke thereon with a pin through said yoke engaged with said primary trigger so that rotation of said body by actuation of said secondary trigger causes actuation of said primary trigger.

18. The hand-carried weapon of claim 17 wherein a bolt interconnects said secondary trigger with said body so that adjustment of said bolt changes the actuation relationship between said secondary trigger and said body.

19. The hand-carried weapon of claim 17 wherein a spring is connected to said secondary trigger to urge said secondary trigger in an actuating direction so that said spring takes lost motion out of said secondary trigger mechanism so that actuation of said secondary trigger directly causes actuation of said primary trigger.

20. A hand-carried weapon comprising:

a receiver-barrel combination containing mechanism in said receiver of the firing of cartridges;

a shoulder stock for engagement against the shoulder of a shooter;

a trigger mounted on said shoulder stock for engagement by the shooter when he places said shoulder stock against his shoulder;

a post interconnecting said shoulder stock and said receiver-barrel combination to support said receiver-barrel combination and its sighting line above the head of a shooter who engages his shoulder against said shoulder stock;

connecting means between said trigger and said mechanism in said receiver for actuating said mechanism when said trigger is actuated;

at least one optical sight mounted with respect to said barrel to establish a sighting line adjacent and substantially parallel to said barrel so that when said sighting line is directed at a point, said barrel can discharge a bullet towards the point; and a periscope on said weapon, a headrest on said periscope, said periscope having first and second reflective optical elements therein, said periscope having a first position in which said first reflective optical element is located so that when the shooter's face lies adjacent said stock with his head against said headrest to stabilize said weapon upon the firing of cartridges, the shooter's eye is in alignment with said first reflective optical element in said periscope and said second reflective optical element in said periscope is on said sighting line for indirect sighting, said second reflective element in said periscope being movable away from said sighting line so that the shooter can place his eye directly on the sighting line for direct sighting.

21. The hand-carried weapon of claim 20 wherein said barrel-receiver is mounted on a fore stock and said fore stock is pivotally mounted with respect to said shoulder stock.

22. The hand-carried weapon of claim 21 wherein there is a handpiece interconnecting said fore stock with the forward end of said shoulder stock forward of said post to secure said fore stock with respect to said shoulder stock.

23. The hand-carried weapon of claim 20 wherein said post carries said periscope.

24. The hand-carried weapon of claim 20 wherein said trigger on said shoulder stock is connected to said receiver through a body movably mounted with respect to said post.

25. The hand-carried weapon of claim 24 wherein there is a cushion secured to said periscope sight to serve as said headrest so that the shooter can engage his forehead against said periscope sight when said periscope sight is in the raised position to steady his head with respect to said periscope sight for sighting therethrough and the shooter can rest his cheek against said periscope sight when said periscope sight is in the lowered position to steady his head when the shooter is sighting along the line-of-sight without optical use of said periscope.

* * * * *